US005884353A

United States Patent [19]

Berg et al.

[11] Patent Number: 5,884,353

[45] Date of Patent: Mar. 23, 1999

[54] SWEEPER WITH HOPPER HEAT SHIELD

[75] Inventors: David W. Berg, Plymouth; Michael S. Wilmo, Crystal, both of Minn.

[73] Assignee: Tennant Company, Minneapolis, Minn.

[21] Appl. No.: 980,798

[22] Filed: Dec. 1, 1997

[51] Int. Cl.[6] ..... A47L 11/18

[52] U.S. Cl. ..... 15/83; 15/87; 15/340.4

[58] Field of Search ..... 15/41.1, 82–87, 15/340.1, 340.2, 340.3, 340.4

[56] References Cited

U.S. PATENT DOCUMENTS 3,461,479 8/1969 Tierney ..... 15/340.1
4,357,727 11/1982 McDowell ..... 15/41.1
4,701,969 10/1987 Berfield et al. ..... 15/83
5,249,332 10/1993 Wilkerson ..... 15/83
5,383,246 1/1995 Hagen ..... 15/83

*Primary Examiner*—Terrence R. Till
*Attorney, Agent, or Firm*—Dorn, McEachran, Jambor & Keating

[57] ABSTRACT

A surface maintenance machine includes a body, wheels for supporting the body, a sweeping brush and a debris hopper adjacent the sweeping brush and positioned to receive debris swept by the brush. The hopper has a floor, walls, and a top, all formed of a plastic material, preferably one rated as not supporting combustion in a horizontal direction. There is a heat shield attached to the underside of the hopper top, with the heat shield being formed of a non-combustible material.

5 Claims, 2 Drawing Sheets

Fig. 3.
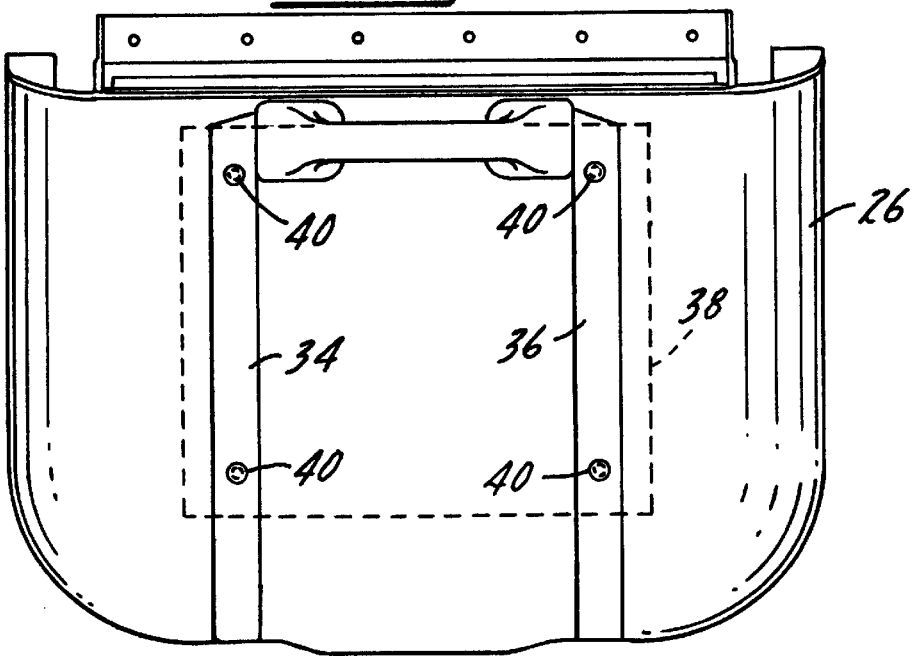
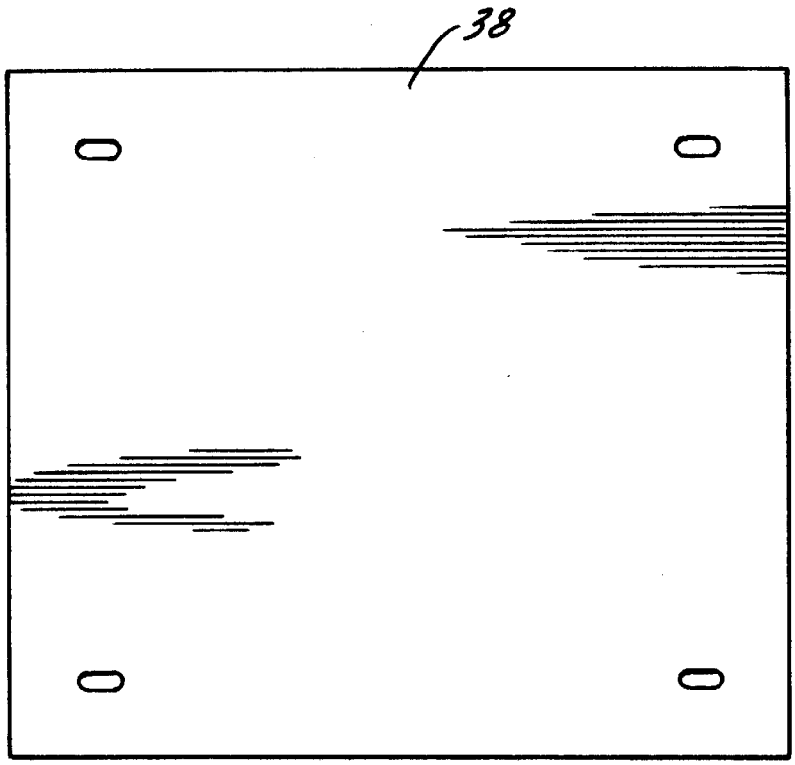
Fig. 4.

SWEEPER WITH HOPPER HEAT SHIELD

THE FIELD OF THE INVENTION

The present invention relates to sweeping machines and more particularly to sweeping machines in which extensive use is made of molded plastic for the main frame, the hopper, the engine enclosure, and the side brush housing. Such plastics, which include high density polyethylene (HDPE) are impact resistant, non-corroding, and lend themselves to very appealing styled products. Such machines in addition combine many parts, thereby providing significant cost savings in production.

Historically, sweepers have always faced a potentially hazardous condition in the matter of hopper fires. Debris that is swept up often includes paper, lint, and other combustible items. Occasionally, the debris may include a live cigarette, a hot clinker, or some other incendiary item and a fire may develop in the hopper. Fanned by the dust control air passing through the hopper, the fire can extensively damage the sweeper. Various thermal sensors have been and still are used in different ways to stop the air flow in the event of an overheated hopper, but natural convection may still support combustion. A hopper built of steel will contain a fire until it burns itself out, but when using a plastic hopper, care must be taken to assure that the hopper itself does not burn and add to the conflagration.

Plastic materials are rated as to their resistance to fire. A plastic might be rated as supporting a slow horizontal burn, or not supporting vertical burn (self-extinguishing). Such characteristics can be demonstrated by striking a match. After it lights, if it is held horizontally, it may go out or a moderate flame may move slowly along it. This is not supporting a horizontal burn. However, if the same match after being lit is held vertically, with the burning end at the bottom, a flame will burn vigorously up the match. This is an example of a material which easily burns in a vertical direction.

In a similar manner, a sheet of plastic rated as supporting a slow horizontal combustion might be laid horizontally and a blow torch applied to it until it starts to burn. If the torch is then removed, the fire will go out. Such a plastic is then rated as not supporting combustion in a horizontal direction. A sheet of the same type of plastic may be placed in a vertical position and a blow torch applied to it until it burns. If the torch is then removed, the plastic may continue to burn vigorously. Such a material would not be rated as not supporting combustion in a vertical direction (self-extinguishing). It takes a more fire resistant grade of material to not support vertical combustion than it does to not support horizontal combustion. Among plastics relatively few are rated as not supporting vertical burn, and such are more expensive and generally do not have the desired properties.

The most commonly used plastic for sweepers is high density polyethylene (HDPE) and it is rated only as not supporting combustion in a horizontal direction. Controlled tests have been undertaken by stuffing a sweeper-hopper made of HDPE full of crumpled paper and lighting it. The hopper floor typically does not burn through. But heat rises so the hopper roof gets much hotter. The part of it directly above the flame reaches its softening temperature and sags down like a bowl. The walls of this sagging portion are nearly vertical and the flame licks up them vigorously. Soon it spreads through the plastic, leaving nothing to contain further spreading of the fire. The fire will also open a hole which tends to feed the fire with oxygen. This problem is becoming more widespread, and hence more critical, as plastics are becoming more common in building sweepers, including their debris hoppers.

The present invention provides an economical and simple solution to the problem described above. A sheet of non-combustible material, such as sheet steel, is placed in the top of the hopper immediately below the hopper roof. In controlled fires this sheet, called a heat shield, has shown that it deflects sufficient heat such that the plastic roof does not soften nor open a hole. Even if the roof does soften, the heat shield supports it and keeps it from sagging down. It is thus prevented from forming vertical surfaces to feed the flame and the fire will bum itself out.

SUMMARY OF THE INVENTION

The present invention relates to sweeping machines and more particularly to a sweeping machine in which the hopper is made of plastic.

A primary purpose of the invention is a sweeping machine of the type described which includes a heat shield, directly beneath the hopper roof, to prevent a fire within the hopper from destroying the sweeping machine.

Another purpose is a sweeping machine as described which includes a heat shield formed of a non-combustible material, fastened to the underside of the hopper roof.

Other purposes will appear in the ensuing specification, drawings and claims.

BRIEF DESCRIPTION OF THE DRAWINGS

The invention is illustrated diagrammatically in the following drawings wherein:

FIG. 3 is a top view of the forward part of the sweeping machine illustrating the hopper; and FIG. 4 is a plan view of the heat shield.

DESCRIPTION OF THE PREFERRED EMBODIMENT

Figure 1:
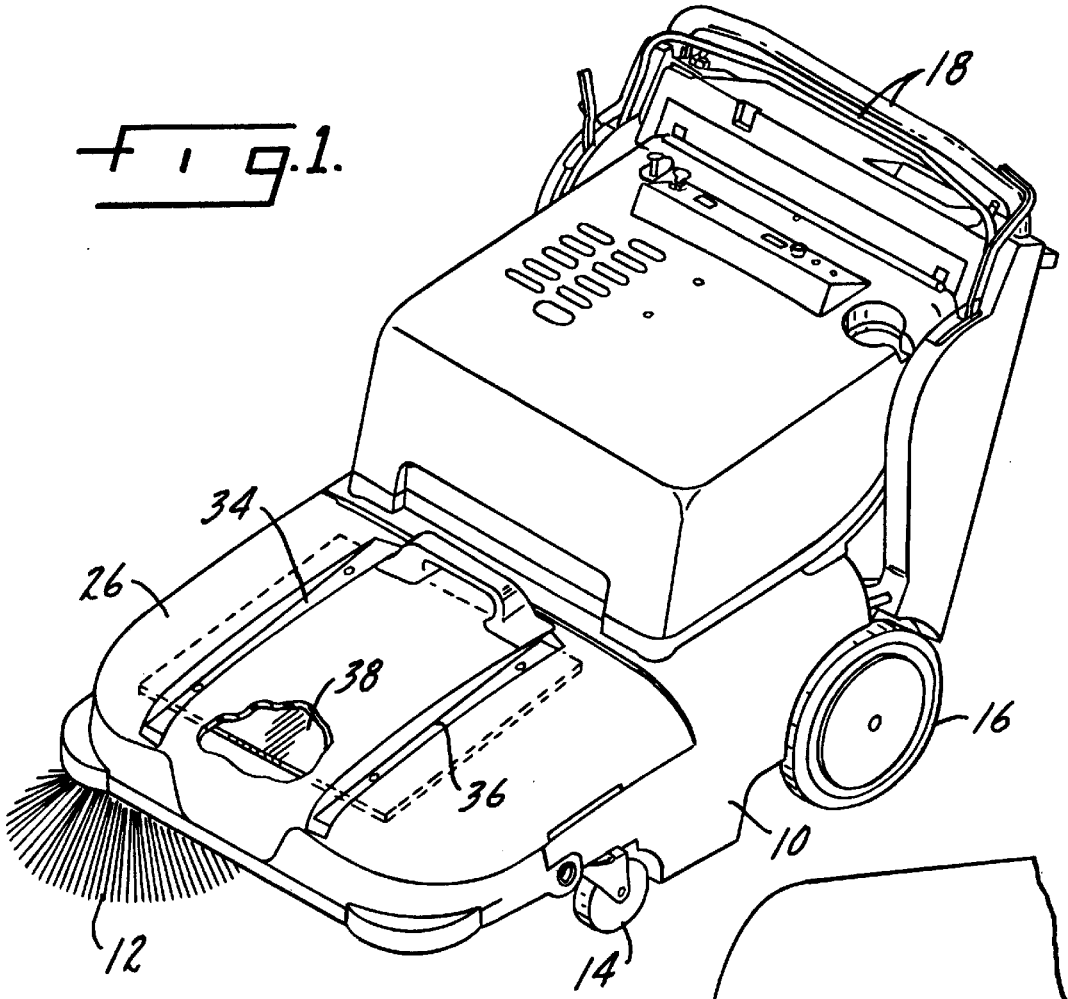
FIG. 1 is a perspective of a sweeping machine of the type described.

In FIG. 1 the sweeping machine includes a frame or body 10, which may be formed of a high density polyethylene as described. The machine includes a side brush 12, forward wheels 14 and rear wheels 16. The machine illustrated is a walk behind sweeper, although the concepts disclosed herein are equally applicable to sweeping machines in which the operator rides on the machine. There are controls 18 for use by the operator.

Figure 2:
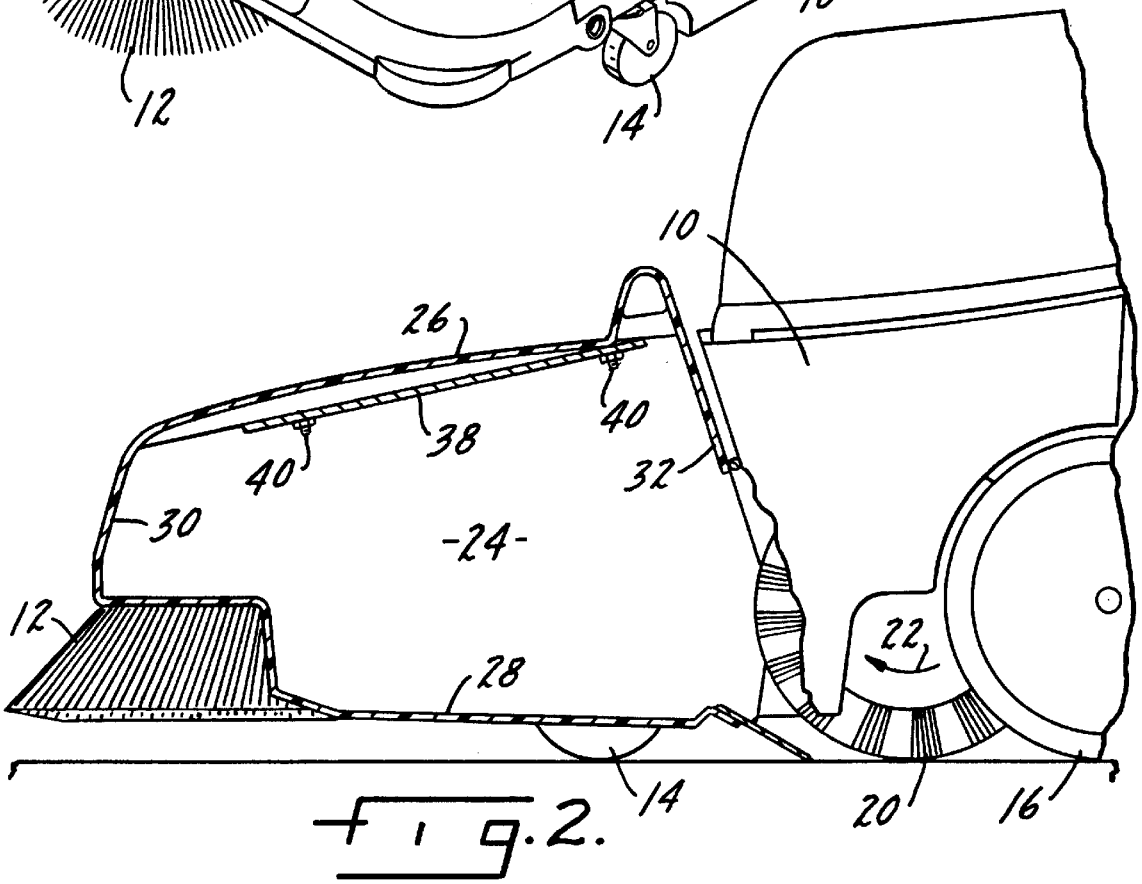
FIG. 2 is a side view, in part section, of the sweeping machine of FIG. 1.

Focusing on FIGS. 2 and 3, the sweeping machine has a main cylindrical brush 20 which rotates in the direction of arrow 22 to direct debris from the surface being cleaned into the hopper 24. The hopper 24 has a top or roof 26, a bottom 28, a forward wall 30, and a rear wall 32. There will be side walls for the hopper which are formed by the frame of the body 10. All of the above-described body parts of the sweeping machine may be formed of HDPE. The hopper is an enclosure and debris will be swept into it. Sweepers include an air system for dust control and such an air system will pass air through the hopper, conventionally driven by a vacuum fan, with the air being cleaned by a typical filter. All of such items are conventional in sweepers of the type described.

The top or roof 26 may have two spaced channels 34 and 36, illustrated in FIG. 3, which are molded into the roof or top. These channels provide a convenient means for attaching a heat shield 38. The heat shield 38 is generally coextensive with the area of the roof 26 and will be attached by typical fasteners 40 to the channels 34 and 36.

The heat shield should be formed of a non-combustible material. It may be sheet steel, aluminum or brass, or it may possibly be formed of a plastic material which is totally impervious to the heat generated by potential fire within the hopper.

Whatever the material used, the heat shield must prevent the roof 26 from forming vertical surfaces which would support combustion if there is a fire within the hopper. By using a heat shield of substantial strength, even if the roof should sag it would not form the described vertical surfaces because the sagging would be limited by the non-combustible shield 38.

Whereas the preferred form of the invention has been shown and described herein, it should be realized that there may be many modifications, substitutions and alterations thereto.

The embodiments of the invention in which an exclusive property or privilege is claimed are defined as follows:

1. A surface maintenance machine including a body, wheels for supporting said body, a sweeping brush, a debris hopper adjacent said sweeping brush and positioned to receive debris swept by said brush, said hopper having a floor, walls and a top, all formed of a plastic material, and a heat shield attached to the underside of said hopper top, said heat shield being formed of a non-combustible material.

2. The surface maintenance machine of claim 1 wherein said plastic material is rated as only supporting combustion in a horizontal direction.

3. The surface maintenance machine of claim 1 wherein said heat shield is of a size and shape to be generally coextensive with said hopper top and is formed of a metallic material.

4. The surface maintenance machine of claim 3 wherein said head shield is formed of sheet steel.

5. The surface maintenance machine of claim 1 wherein said hopper top has a pair of longitudinally extending channels formed therein, said heat shield being attached to the underside of said channels and being generally coextensive with the area of said hopper top.

* * * * *